US008017177B2

(12) United States Patent
Kamata et al.

(10) Patent No.: US 8,017,177 B2
(45) Date of Patent: Sep. 13, 2011

(54) METHOD OF AUTOMATICALLY MARKING ARTICLE AND AUTOMATIC MARKING DEVICE

(75) Inventors: Takeshi Kamata, Shizuoka (JP); Shigeharu Suzuki, Shizuoka (JP); Keigo Sugimura, Shizuoka (JP); Kiyoshi Yagi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 717 days.

(21) Appl. No.: 10/523,975

(22) PCT Filed: Aug. 6, 2003

(86) PCT No.: PCT/JP03/09993

§ 371 (c)(1),
(2), (4) Date: Aug. 18, 2005

(87) PCT Pub. No.: WO2004/015722

PCT Pub. Date: Feb. 19, 2004

(65) Prior Publication Data

US 2006/0100736 A1 May 11, 2006

(30) Foreign Application Priority Data

Aug. 9, 2002 (JP) ..... 2002-233729
Jul. 8, 2003 (JP) ..... 2003-193904

(51) Int. Cl.
*G06F 19/00* (2011.01)

(52) U.S. Cl. ..... 427/117; 427/424

(58) Field of Classification Search ..... 427/117, 427/424; 118/314, 325, 113; 101/171, 211, 101/34

See application file for complete search history.

(56) References Cited

U.S. PATENT DOCUMENTS 2,428,284 A * 9/1947 Krogel ..... 118/314
(Continued)

FOREIGN PATENT DOCUMENTS

DE 26 43 353 A1 3/1978
(Continued)

OTHER PUBLICATIONS

Office Action (Text Portion of observations and amended application documents filed on Jan. 16, 2007) of Chinese Patent Application No. 03821298.6.

(Continued)

*Primary Examiner* — Timothy H Meeks
*Assistant Examiner* — Tabassom Tadayyon Eslami
(74) *Attorney, Agent, or Firm* — Kratz, Quintos & Hanson, LLP

(57) ABSTRACT

A method and device for automatically marking an article are provided, by which the deterioration in the yield can be prevented from occurring and a color of a mark to be formed on the article can be easily changed. A device 1 for automatically marking an electric wire as a device for automatically marking an article marks an outer surface 3*a* of an electric wire 3. The device 1 includes first and second spouting means 311, 321, encoder 33 and control device 34. The first spouting means 311 spouts a specific amount of a first coloring agent toward the outer surface 3*a* of the electric wire 3. The second spouting means 312 spouts a specific amount of a second coloring agent toward the outer surface 3*a* of the electric wire 3. The encoder 33 detects a transfer speed of the electric wire 2 which is transferred in a direction of arrow K. The control device 34 makes the first and second spouting means 311, 312 spout the coloring agent according to a pattern predetermined in advance in response to the transfer speed of the wire 3 detected by the encoder 33.

9 Claims, 11 Drawing Sheets

U.S. PATENT DOCUMENTS

| | | | | | |
|---|---|---|---|---|---|
| 2,749,880 | A | * | 6/1956 | Richardson et al. | 118/411 |
| 3,068,838 | A | * | 12/1962 | Gemelli | 118/316 |
| 3,805,276 | A | * | 4/1974 | Ishii | 347/85 |
| 3,995,772 | A | * | 12/1976 | Liautaud | 222/83.5 |
| 4,503,437 | A | * | 3/1985 | Katzschner | 347/43 |
| 4,877,645 | A | * | 10/1989 | Bleich et al. | 427/117 |
| 5,237,917 | A | * | 8/1993 | Traut et al. | 101/35 |
| 5,645,899 | A | * | 7/1997 | Unterberger | 427/558 |
| 6,049,351 | A | * | 4/2000 | Noguchi et al. | 347/249 |
| 6,328,488 | B1 | * | 12/2001 | Kobayashi | 396/604 |
| 6,481,824 | B1 | * | 11/2002 | Hayakawa et al. | 347/24 |

FOREIGN PATENT DOCUMENTS

| | | | |
|---|---|---|---|
| DE | 29 44 103 | A1 | 4/1981 |
| GB | 1536179 | | 12/1978 |
| JP | 10-031918 | | 2/1998 |

OTHER PUBLICATIONS 10-31918, Feb. 3, 1998, Japan, International Search Report.*
9-219119, Aug. 19, 1997, Japan, International Search Report.*
62-270217, Nov. 24, 1987, Japan, International Search Report.*

* cited by examiner

METHOD OF AUTOMATICALLY MARKING ARTICLE AND AUTOMATIC MARKING DEVICE

TECHNICAL FIELD

The present invention relates to a method and device for automatically marking an article such as an electric wire including an electrically conductive core wire and an insulating coating which coats the core wire.

BACKGROUND ART

Various electronic equipment is mounted on a motor vehicle as a mobile unit. Therefore, a motor vehicle is provided with a wiring harness for supplying an electric power from an electric source to electronic equipment and for transferring control signals and so on from a computer to electronic equipment. The wiring harness includes a plurality of electric wires 106 (shown in FIG. 14) as articles, electric connectors, each being attached to an end of the wire 106, and so on.

The wire 106 includes an electrically conductive core wire 105 (shown in FIG. 14) and a coating made of insulating synthetic resin, which coats the core wire 105. The wire 106 is so-called a coated wire. The wire 106 has been produced by using a producing device 100 shown in FIG. 14, which includes a supply unit 101, extrusion-coating unit 102, cooling water bath 103 and winding unit 104.

Upon producing the wire 106, the producing device 100 transfers a core wire 105 or a wire 106 in turn through the supply unit 101, extrusion-coating unit 102, cooling water bath 103 and winding unit 104. The device 100 has a plurality of pulleys 107 to transfer the core wire 105 or wire 106.

The supply unit 101 supplies the core wire 105 which has no coating thereon. The extrusion-coating unit 102 extrudes the insulating synthetic resin onto the circumference of the core wire 105 supplied from the supply unit 101, forming the coating. The cooling water bath 103 cools the coating. The winding unit 104 cuts the wire 106 into a specific length and winds the cut wire 106 around a drum or the like placing the wire 106 in a condition of being shipped. Thus, the producing device 100 produces the wire 106.

A connector includes an electrically conductive terminal fitting and an insulating connector housing. The terminal fitting is attached to an end of the wire 106 and electrically connected to the core wire 105 of the wire 106. The connector housing is formed into a box-shape and receives the terminal fitting.

Upon assembling a wiring harness, first the wire 106 is cut into a specific length and thereafter a terminal fitting is attached to an end of the wire 106. The wires 106 are connected to each other according to the need. Thereafter, the terminal fitting is inserted into the connector housing, thereby assembling the wiring harness.

As for the wire 106 of the wiring harness, the size of the core wire 105, the material of the coating (for possible change in the material depending on heat-resisting property), and a purpose of use must be distinguished. Here, the purpose of use means a control signal for an air-bag, antilock brake system and vehicle speed information, and a vehicle system in which the wire 106 in a power transmission system is used.

So far, in order to distinguish the purpose of use as described above, an outer surface of the wire 106 of the wiring harness is formed in a stripe pattern with two different colors. In a conventional producing device 100 as shown in FIG. 14, in an extrusion-coating unit 102, a coloring agent is added into the synthetic resin which constitutes the coating. Then, in the extrusion-coating unit 102, the synthetic resin is mixed with the coloring agent so as to make the color of the synthetic resin be the same as that of the coloring agent. Then, the synthetic resin having the same color as that of the coloring agent is extrusion-coated onto the circumference of the core wire 105. Further, a part of the outer surface of the wire 106 is colored with a color different from the color of the coloring agent, thereby coloring the wire 106 into a stripe pattern.

A maker of motor vehicles receives various demands from users. That is, a motor vehicle is forced to have various electronic equipment therein. Accordingly, the wiring harness needs many types of the wire 106, such as a hundred of types of the wire 106. In this case, the wires 106 having various colors are needed. Therefore, the producing device 100 must frequently change the color of the coating of the wire 106.

In the conventional producing device 100 as shown in FIG. 14, upon changing the color of the coating (that is, the color of the wire 106), the extrusion-coating unit 102 is halted once and then, the coloring agent to be mixed with the synthetic resin is changed. In this case, when the wires 106 having various colors are produced, the extrusion-coating unit 102 must be halted frequently, causing the deterioration in the production efficiency of the wire 106.

Therefore, a method has been proposed, in which the coloring agent to be added to the synthetic resin is changed with the extrusion-coating unit 102 being kept in operation. When the coloring agent is changed with the extrusion-coating unit 102 being kept in operation, immediately after changing the coloring agent, the synthetic resin is mixed with both the coloring agent before the change and the coloring agent after the change, resulting in that the color of the coating becomes a mixed color of the color of the coloring agent before the change and that of the coloring agent after the change. The wire 106 having such a mixed color cannot be used for making a wiring harness because the mixed color is not a desired color to be used in the system described above. That is, when the coloring agent is changed with the extrusion-coating unit 102 being kept in operation, the resulted wire 106 has inevitably a portion which cannot be used to make a wiring harness, causing the deterioration in the yield of the material of the wire 106. Further, a part of the outer surface cannot be easily changed to a color which is different from the color of the coloring agent.

Thus, with the conventional producing device, it has been difficult to change a color of a mark, which is formed on the outer surface of the wire, without deteriorating the production efficiency of the wire as an article.

It is therefore an objective of the present invention to provide a method and device for automatically marking an article, by which the deterioration in the yield can be prevented from occurring and a color of a mark to be formed on the article can be easily changed.

DISCLOSURE OF INVENTION

In order to attain the above objective, the present invention is a method of automatically marking an article which is transferred in one direction, comprising the steps of:

storing in advance a pattern for coloring an outer surface of the article with a plurality of coloring agents of respective colors different from each other;

detecting a transfer speed of the article; and spouting a plurality of the coloring agents of respective specific amount toward the outer surface of the article according to the pattern in response to the detected transfer speed.

According to the present invention, a plurality of the coloring agents of the respective specific amount are spouted toward the outer surface of the article so as to mark the outer surface. Since the coloring agents of the respective specific amount are spouted, therefore when one coloring agent is replaced by the other coloring agent, the coloring agent is prevented from being mixed with the other coloring agent and the coloring agent to be adhered on the article can be changed immediately.

Further, the transfer speed of the article is detected and a plurality of the coloring agents are spouted toward the outer surface of the article in response to the detected transfer speed. When the transfer speed of the article increases, then a time interval for spouting the coloring agent is shortened, while the transfer speed of the article decreases, then a time interval for spouting the coloring agent is elongated, thereby the distance between the coloring agents adhered on the outer surface of the article can be maintained constant even when the transfer speed of the article changes. Consequently, even when the transfer speed of the article changes, the coloring agents can be adhered on the outer surface of the article according to a predetermined pattern.

The coloring agent means a liquid substance, in which a coloring material (organic substance for use in industry) is dissolved and dispersed in water or other solvent. The organic substance described above is a dye or a pigment (mainly, organic substance and synthetic product). Sometimes, a dye is used as a pigment and a pigment is used as a dye. In this specification, as a substantial example, the coloring agent is a coloring liquid or coating material.

The coloring liquid is a liquid, in which a dye is dissolved or dispersed in a solvent. The coating material is a material, in which a pigment is dispersed in a liquid dispersion. When the outer surface of the wire is colored with a coloring liquid, the dye permeates into the coating. When the outer surface of the wire is colored with a coating material, the pigment adheres to the outer surface without permeating into the coating of the wire. In the specification, "to mark the outer surface of the coating" means to dye a part of the outer surface of the coating with a dye or to coat a part of the outer surface of the coating with a pigment.

Preferably, the solvent and liquid dispersion have an affinity to the synthetic resin for constituting the coating in order to securely permeate the dye into the coating of the wire or to make the pigment securely adhere to the outer surface of the coating of the wire.

The present invention is a method of automatically marking an article wherein the article is an electric wire.

According to the present invention, the outer surface of an electric wire as the article is marked. Since the marking is carried out in response to the transfer speed of the wire, the coloring agents can be adhered on the outer surface of the wire according to a predetermined pattern even when the transfer speed of the wire changes. Of course, the wire being transferred with a high speed can be securely marked and the wire of long length can be marked.

The present invention is a device for automatically marking an article which is transferred in one direction, comprising:

storing means for storing a pattern for coloring an outer surface of the article with a plurality of coloring agents of respective colors different from each other;

detecting means for detecting a transfer speed of the article;

a plurality of spouting means for spouting the coloring agents of respective colors different from each other of respective specific amount toward the outer surface of the article; and control means to make a plurality of the spouting means spout the coloring agent toward the outer surface of the article according to the pattern in response to the transfer speed of the article detected by the detecting means.

According to the present invention, a plurality of the spouting means spout the respective specific amount of the coloring agents toward the outer surface of the article so as to mark the outer surface. A plurality of the spouting means spout the coloring agent of the respective different colors. Since the respective specific amount of the coloring agents are spouted, when one coloring agent to be adhered on the article is replaced by the other coloring agent, one coloring agent is prevented from being mixed with the other coloring agent and the coloring agent to be adhered on the article can be changed immediately.

Further, the detecting means detects the transfer speed of the article and the control means controls the spouting of a plurality of the coloring agents toward the outer surface of the article in response to the detected transfer speed. When the transfer speed of the article increases, then a time interval for spouting the coloring agent is shortened, while the transfer speed of the article decreases, then a time interval for spouting the coloring agent is elongated, thereby the distance between the coloring agents adhered on the outer surface of the article can be maintained constant even when the transfer speed of the article changes. Consequently, even when the transfer speed of the article changes, the coloring agents can be adhered on the outer surface of the article according to a predetermined pattern stored in the storing means.

The present invention is a device for automatically marking an article, wherein a plurality of the spouting means are arranged along the transfer direction of the article and the control means makes the spouting means spout the coloring agent according to a distance between the spouting means.

According to the present invention, a plurality of the spouting means are arranged along the transfer direction of the article. Therefore, the outer surface of the article can be securely marked with a plurality of the coloring agents. Further, the storing means stores a distance between the spouting means and the control means controls the spouting means to spout the coloring agent according to the distance between the spouting means. Accordingly, the coloring agents can be adhered on the outer surface of the article according to a predetermined pattern stored in the storing means.

The present invention is a device for automatically marking an article, wherein a plurality of the spouting means are arranged along a circumferential direction around the article.

According to the present invention, a plurality of spouting means are arranged along a circumferential direction around the article. Therefore, the outer surface of the article can be securely marked with a plurality of the coloring agents. Since a plurality of the spouting means are arranged along a circumferential direction around the article, the device for automatically marking an article can be made compact.

Further, since a plurality of the spouting means are arranged along a circumferential direction around the article, a distance between means for transferring the article and the spouting means along the transferring direction of the article, that is, for example, the length direction of the electric wire can be shortened. Therefore, the article can be prevented from shaking in the vicinity of the spouting means, thereby the spouting means can securely mark the outer surface of the article.

The present invention is to a device for automatically marking an article, wherein the spouting means spouts the coloring agent through an opening, which faces the outer surface of the article, a straight line obtained by connecting a center of the opening and a center of the article runs along a spouting direction of the coloring agent, and the spouting direction crosses both perpendicular and horizontal directions at an angle of 45°.

According to the present invention, the spouting means spouts the coloring agent through an opening, which faces the outer surface of the article, a straight line obtained by connecting a center of the opening and a center of the article runs along a spouting direction of the coloring agent, and the spouting direction crosses both perpendicular and horizontal directions at an angle of 45°. Therefore, even when the article shakes both in the perpendicular and horizontal directions, the spouting means can securely mark the outer surface of the article.

The present invention is to a device for automatically marking an article, further comprising a device body for receiving the storing means and the control means, wherein the device body comprises a plurality of connectors for connecting the device body to the spouting means and the connectors are provided in the same number as that of the spouting means according to the respective spouting means.

According to the present invention, the device comprises a device body for receiving the storing means and the control means, wherein the device body comprises a plurality of connectors for connecting the device body to the spouting means and the connectors are provided in the same number as that of the spouting means according to the respective spouting means. Therefore, with one device body, a plurality of the spouting means can be securely controlled and a space for installing the device can be reduced.

The present invention is a device for automatically marking an article, wherein the article is an electric wire.

According to the present invention, the outer surface of an electric wire as the article is marked. Since the marking is carried out in response to the transfer speed of the wire, the coloring agents can be adhered on the outer surface of the wire according to a predetermined pattern even when the transfer speed of the wire changes. Of course, the wire being transferred with a high speed can be securely marked and the wire of long length can be marked.

The present invention is to a device for automatically marking an article, wherein the electric wire is put in an electric wire cutting machine which cuts the electric wire after transferring the electric wire in said one direction.

According to the present invention, the electric wire is put in an electric wire cutting machine which cuts the electric wire after transferring the electric wire in said one direction. Therefore, when a long electric wire is cut into a specific length, the wire can be marked with a specific pattern. A space for installing can be reduced and a man-hour for processing the wire can be reduced.

BEST MODE FOR CARRING OUT THE INVENTION

Figure 1:
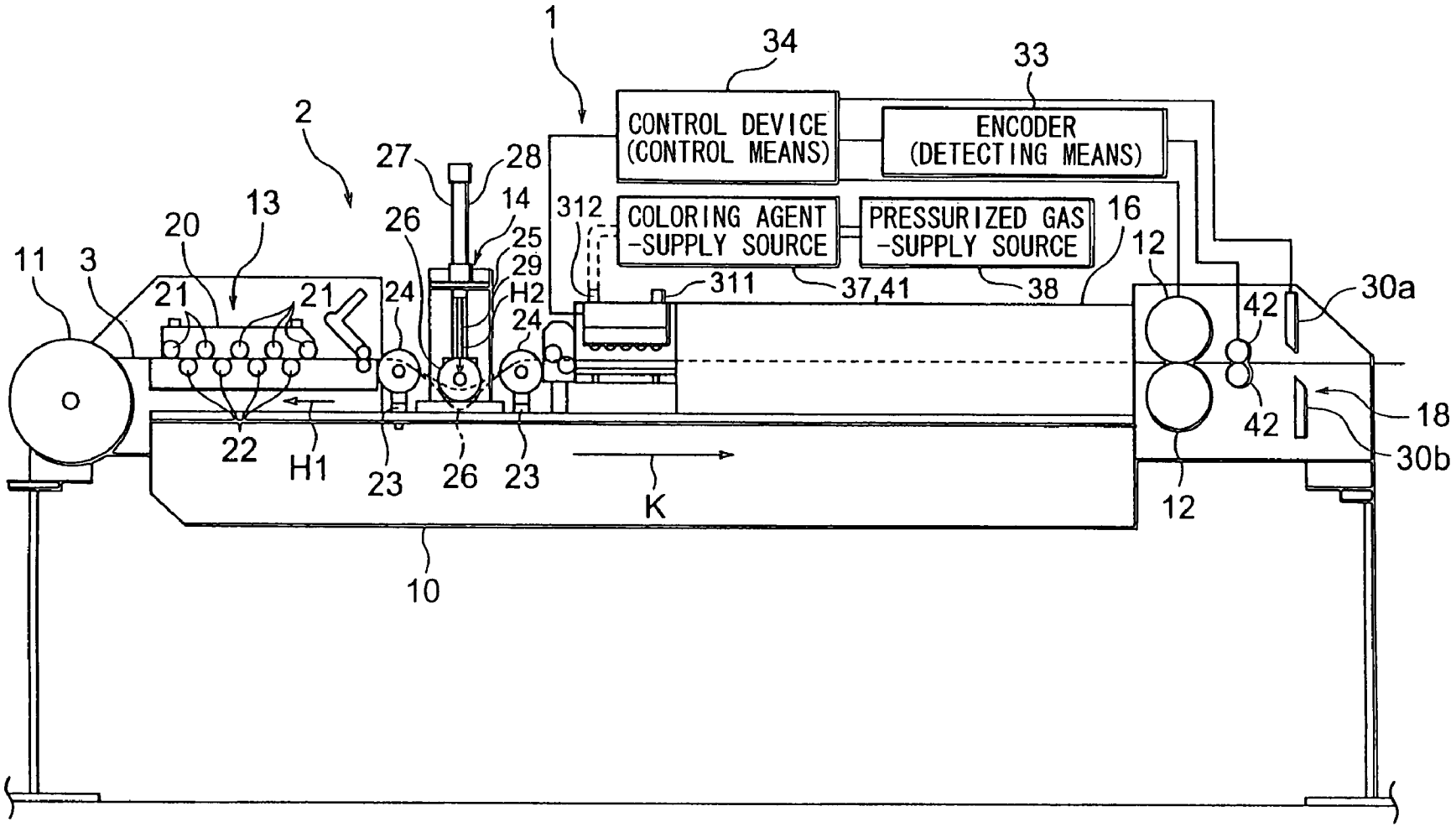
FIG. 1 illustrates a construction of an electric wire cutting machine to which a device for automatically marking an article according to the first preferred embodiment of the present invention is mounted.

In the following, a device for automatically marking an electric wire (hereinafter, a device for automatically marking) as a device for automatically marking an article according to a first preferred embodiment of the present invention will be explained with reference to FIGS. 1-7. As shown in FIG. 1, the device 1 for automatically marking is mounted on an electric wire cutting machine 2, which cuts the wire 3 into a specific length, and the device 1 forms a mark 9 on a part of the outer surface 3*a* of the wire 3. That is, the device 1 for automatically marking marks the outer surface 3*a* of the wire 3 as the article.

As shown in FIG. 1, the electric wire cutting machine 2 includes a frame 10 as a machine body, guide roll 11, delivery roll 12 as a transfer means, corrective unit 13 as means for providing tension, slack-absorbing unit 14 as means for absorbing a slack, duct 16, and cutting mechanism 18 as means for processing.

The frame 10 is placed on a floor in a plant. The frame 10 extends in a horizontal direction. The guide roll 11 is rotatably attached to an end of the frame 10. The guide roll 11 winds up a long electric wire 3 on which a mark 9 is not formed. The guide roll 11 delivers the wire 3 in sequence to the corrective unit 13, slack-absorbing unit 14, spouting unit 311, 312, duct 16, encoder 33 and cutting mechanism 18.

A pair of the delivery rolls 12 are provided at an opposite end of the frame 10. The pair of the delivery rolls 12 is rotatably supported by the frame 10 and is arranged along the vertical direction. The delivery roll 12 is rotated in a direction reverse to that for the mating delivery roll 12 with the same revolving speed as that of the mating delivery roll 12 by a motor (not shown in the figure). The pair of the delivery rolls 12 puts the wire 3 therebetween and pulls the wire 3 from the guide roll 11 in the longitudinal direction of the wire 3.

The delivery roll 12 functions as means for pulling the wire 3 in the longitudinal direction of the wire 3 so as to transfer the wire 3. Thus, the delivery rolls 12 transfer the wire 3 in the longitudinal direction of the wire 3 so that the wire 3 is moved in the longitudinal direction of the wire 3 relatively to a coloring nozzle 351, 352 (explained later on) of the spouting unit 311, 312. That is, the wire 3 is transferred from the guide roll 11 toward the delivery roll 12 along an arrow K shown in FIG. 1. The arrow K indicates the transfer direction of the wire 3.

The corrective unit 13 is provided at the delivery roll 12-side of the guide roll 11, that is, between the guide roll 11 and delivery roll 12. That is, the corrective unit 13 is provided at the downstream side of the guide roll 11 in the transfer direction K of the wire 3 and provided at the upstream side of the delivery roll 12 in the transfer direction K of the wire 3. The corrective unit 13 includes a plate-shaped unit body 20, a plurality of first rollers 21, and a plurality of second rollers 22. The unit body 20 is fixed to the frame 10.

The first and second rollers 21, 22 are rotatably supported by the unit body 20. A plurality of the first rollers 21 are arranged along the horizontal direction (i.e. the transfer direction K) above the wire 3. A plurality of the second rollers 22 are arranged along the horizontal direction (i.e. the transfer direction K) below the wire 3. The first and second rollers 21, 22 are provided zigzag as shown in FIG. 1.

The corrective unit 13 puts the wire 3, which is delivered from the guide roll 11 by the delivery roll 12, between the first and second rollers 21, 22. The corrective unit 13 makes the wire 3 straight. The corrective unit 13 gives friction force to the wire 3 by putting the wire 3 between the first and second rollers 21, 22. That is, the corrective unit 13 gives the wire 3 the friction force, which is a first bias force H1 acting in a direction reverse to the direction (i.e. the transfer direction K) in which the delivery roll 12 pulls the wire 3. The first bias force H1 is smaller than a force that the delivery roll 12 pulls the wire 3. Therefore, the corrective unit 13 gives the tension acting along the longitudinal direction of the wire 3 to the wire 3 so as to stretch the wire 3.

The slack-absorbing unit 14 is provided at the delivery roll 12-side of the corrective unit 13, that is, provided between the corrective unit 13 and the delivery roll 12. That is, the slack-absorbing unit 14 is provided at the downstream side of the corrective unit 13 along the transfer direction K of the wire 3 and provided at the upstream side of the delivery roll 12 along the transfer direction K of the wire 3. The slack-absorbing unit 14 is provided between the corrective unit 13 and the spouting units 311, 312.

Figure 2:
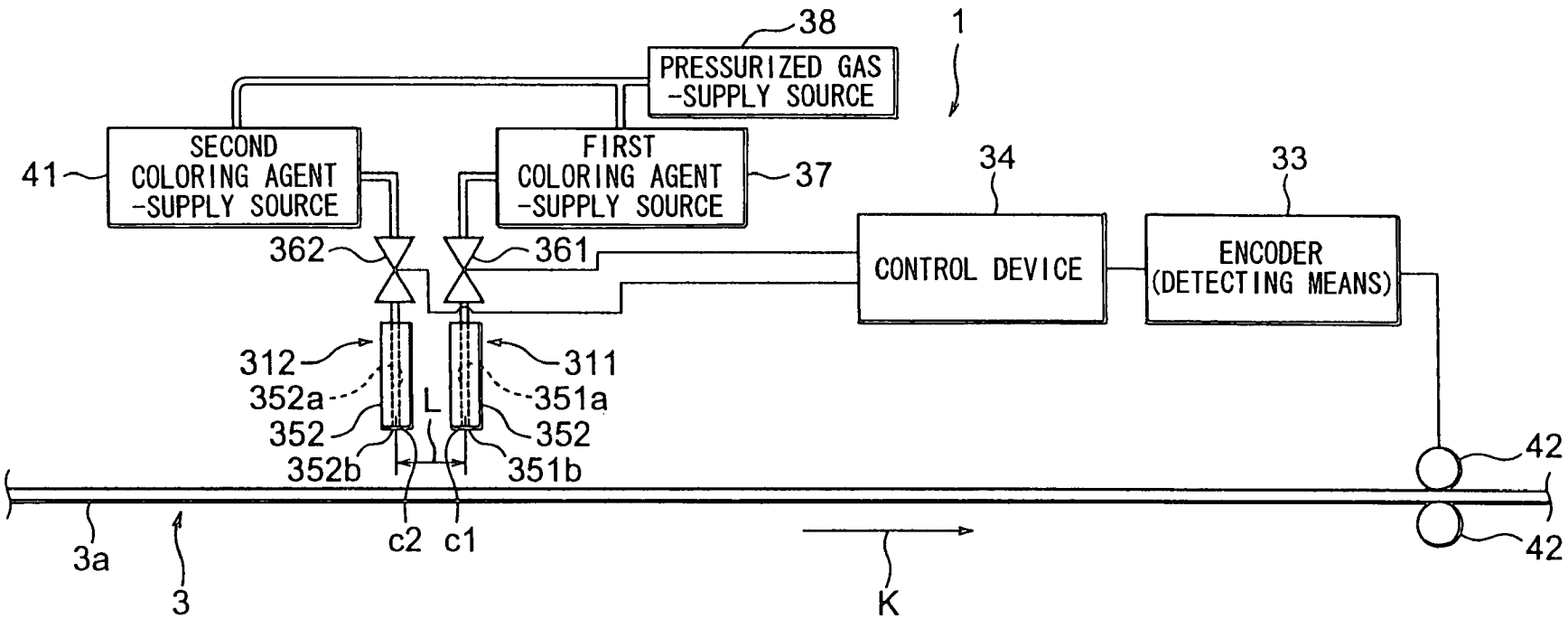
FIG. 2 illustrates a construction of the device for automatically marking an article shown in FIG. 1.

As shown in FIGS. 1 and 2, the slack-absorbing unit 14 includes frames 23 for supporting a pair of guide rollers, the pair of the guide rollers 24, a frame 25 for supporting a transfer roller, the transfer roller 26, and air cylinder 27 as bias means. The frames 23 are fixed to the frame 10. The frames 23 are provided above the frame 10. The frames 23 are arranged in the transfer direction K of the wire 3 having a distance therebetween.

The pair of the guide rollers 24 is rotatably supported by the frame 23. The guide roller 24 is placed below the wire 3 and guides the wire 3 so that the wire 3 does not come off from the transfer direction K by coming in contact with the wire 3 on the outer surface of the guide roller 24. That is, the guide roller 24 guides the wire 3 along the transfer direction K.

The frame 25 is fixed to the frame 10. The frame 25 rises upward from the frame 10. The frame 25 is provided between the pair of the frames 23.

The transfer roller 26 is rotatably supported by the frame 25 and supported movably in the vertical direction. The transfer roller 26 is placed above the wire 3. The transfer roller 26 is supported movably in the vertical direction, so that the transfer roller 26 is supported movably in a direction crossing the transfer direction K of the wire 3 at right angles. The transfer roller 26 is provided at the center between the rollers 24.

The air cylinder 27 includes a cylinder body 28 and a stretch rod 29 stretchable from the body 28. The cylinder body 28 is fixed to the frame 25 and placed above the wire 3. The stretch rod 29 extends downward from the body 28. That is, the stretch rod 29 extends toward the wire 3 from the body 28.

The transfer roller 26 is attached to the stretch rod 29. By receiving pressurized gas in the cylinder body 28, the air cylinder 27 biases the stretch rod 29, that is, biases the transfer roller 26 downward along the direction crossing the transfer direction K at right angles with a second bias force H2 (shown in FIGS. 1 and 2). That is, the air cylinder 27 biases the transfer roller 26 toward the wire 3 with the second bias force H2. The second bias force H2 is smaller than the first bias force H1.

When a pair of cutting blades 30*a* and 30*b* (explained later on) of the cutting mechanism 18 approaches each other and the wire 3 is stopped to be cut, the wire 3 advances along arrow K by inertia and the wire 3 slackens between the pair of the guide rollers 24. At this time, in the slack-absorbing unit 14, since the air cylinder 27 biases the transfer roller 26 with the second bias force H2, the stretch rod 29 of the air cylinder 27 extends and the transfer roller 26 is displaced, for example, to a position indicated by an alternate long and two short dashes line shown in FIG. 2. Then, the slack-absorbing unit 14 biases the wire 3, which slackens between the guide rollers 24, along the direction crossing the transfer direction K at right angles so as to absorb the slack, thereby keeping the wire 3 stretching.

The duct 16 is provided at the delivery roll 12-side of the spouting units 311, 312 (explained later on) of the device 1 for automatically marking and provided between the spouting units 311, 312 and the delivery roll 12. That is, the duct 16 is provided at the downstream side of the spouting units 311, 312 along the transfer direction of the wire 3. The duct 16 is formed cylindrical and guides the wire 3 therethrough. The duct 16 is connected to suction means (not shown in the figure) such as a vacuum pump. The suction means sucks gas in the duct 16 so as to prevent solvent or fluid dispersion in the coloring agent from leaking out from the device 1.

The cutting mechanism 18 is arranged at the downstream side of a pair of rotors 42 of the encoder 33 (explained later on) of the device 1 along the transfer direction K of the wire 3. The cutting mechanism 18 includes a pair of cutting blades 30*a* and 30*b*, which is arranged in the vertical direction. When the pair of cutting blades 30*a* and 30*b* approaches each other, the pair of cutting blades 30*a* and 30*b* puts the wire 3, which is delivered by the pair of the delivery rolls 12, therebetween and cuts the wire 3. When the pair of cutting blades 30*a* and 30*b* parts away from each other, of course the pair of cutting blades 30*a* and 30*b* parts away from the wire 3.

The electric wire cutting machine 2 puts the wire 2 between the delivery rolls 12, in a state that the pair of cutting blades 30*a* and 30*b* parts away from each other, and delivers the wire 3 along arrow K. After delivering the wire 3 of a specific length, the delivery roll 12 is halted. Then, the pair of cutting blades 30*a* and 30*b* approaches each other, puts the wire 3 therebetween, and cuts the wire 3. Thus, the electric wire cutting machine 2 transfers the wire 3 as an article along arrow K.

Figure 6:
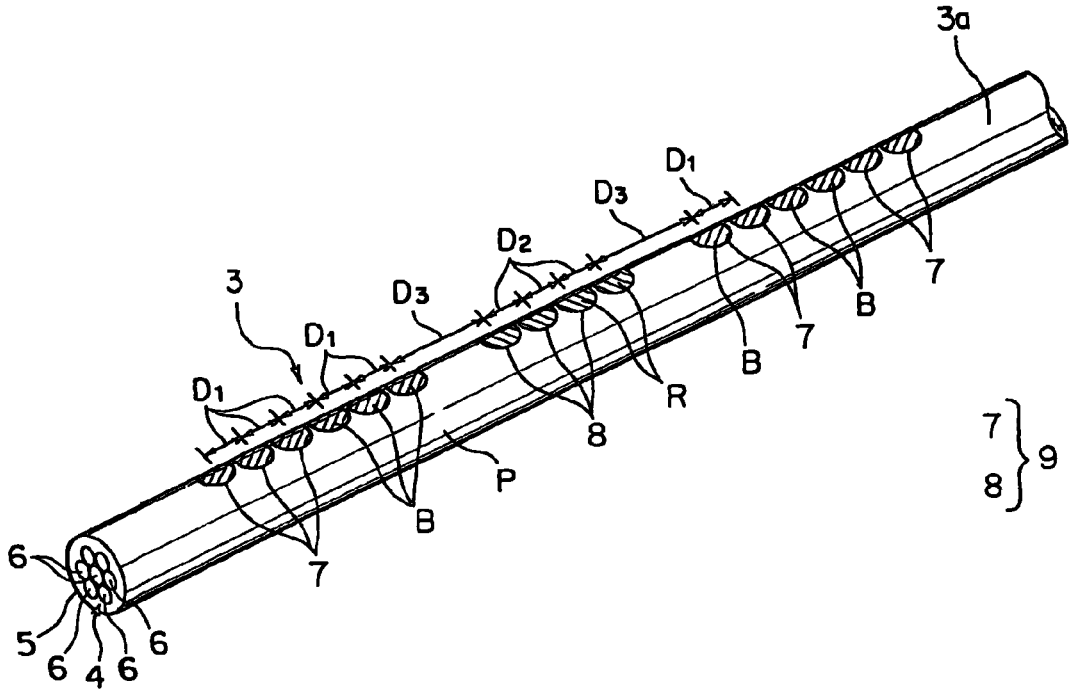
FIG. 6 is a perspective view of an electric wire which is marked by the device for automatically marking an article shown in FIG. 2.

As shown in FIG. 6, the device 1 for automatically marking marks the outer surface 3*a* of the wire 3. The wires 3 constitute a wiring harness, which is arranged in, for example, a motor vehicle as a mobile unit.

The wire 3 includes an electrically conductive core wire 4 and an electrically insulating coating 5. The core wire 4 is formed by twisting a plurality of element wires 6 made of conductive metal. The core wire 4 may be constructed by one element wire 6. The coating 6 is made of synthetic resin such as polyvinyl chloride (PVC). The coating 5 coats the core wire 4. Therefore, the outer surface 3*a* of the wire 3 is the outer surface of the coating 5.

The coating is monochrome P. The outer surface 3*a* of the wire 3 may be monochrome P by mixing a desired coloring agent into the synthetic resin of the coating 5. Alternatively, the monochrome P may be a color of the synthetic resin itself without mixing a coloring agent into the synthetic resin of the coating 5. In the latter case, the outer surface 3*a* of the wire 3, that is, the outer surface of the coating 5 is called non-colored. That is, the "non-colored" means that the outer surface 3*a* of the wire 3 has a color of the synthetic resin itself.

On the outer surface 3*a* of the wire 3, a mark 9 consisting of a plurality of first spots 7 and a plurality of second spots 8 is formed. The first spot 7 has a first color B (shown by parallel diagonal lines in FIGS. 6 and 7). The first color B is different from the monochrome P. The second spot 8 has a second color R (shown by other parallel diagonal lines in FIGS. 6 and 7). The second color R is different from both the monochrome P and the first color B.

Figure 7:
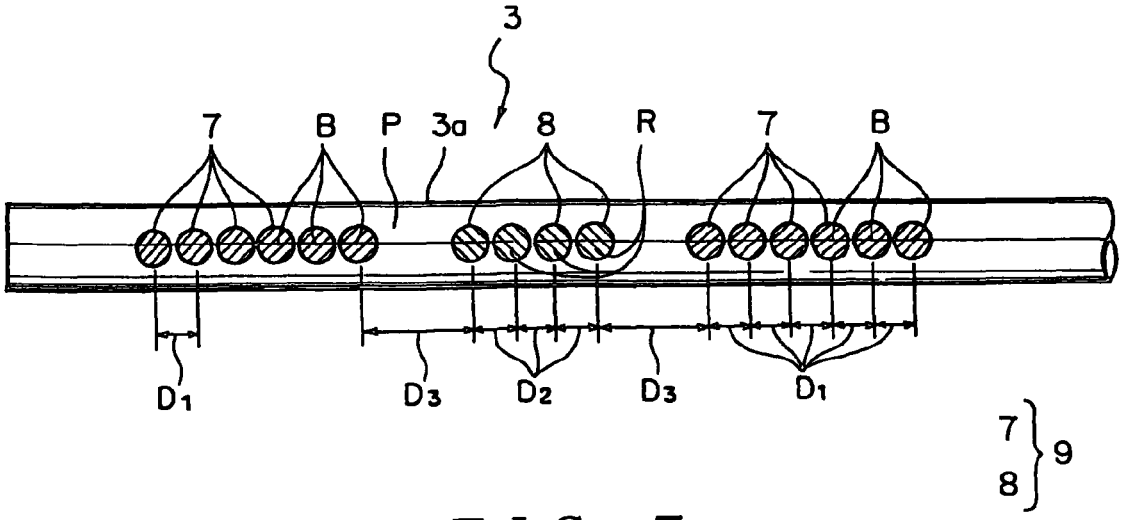
FIG. 7 is a plan view of the electric wire shown in FIG. 6.

As shown in FIG. 7, the first and second spots 7, 8 are round in a plan view. A plurality of the spots 7 and a plurality of the spots 8 are arranged in the longitudinal direction of the wire 3 according to a predetermined pattern.

In this example of the figure, six first spots 7 are formed, then four second spots 8 are formed and then, six first spots 7 are further formed. The following three distances are predetermined: a distance D1 between the centers of the first spots 7 adjacent to each other in the longitudinal direction of the wire 3; a distance D2 between the centers of the second spots 8 adjacent to each other in the longitudinal direction of the wire 3; and a distance D3 between the center of the first spot 7 and the center of the second spot 8 adjacent to each other in the longitudinal direction of the wire 3.

A plurality of the wire 3 constructed as described above are twisted and, for example, a connector is attached thereto, thereby constructing the wiring harness. The connector is coupled with a mating connector of various electronic equipment in a motor vehicle, thereby the wiring harness, i.e. the wires 3 transfer various signals or electric power to the various electronic equipment. The wire 3 is the article described in the claims and this specification.

By changing the colors B and R of the respective spots 7 and 8 of the mark 9, the wire 3 can be distinguished from the other wire 3. The colors B and R are used to distinguish the type of the wire 3 of the wiring harness and to distinguish a system in a vehicle, that is, to distinguish a purpose of the wire 3 of the wiring harness.

The device 1 for automatically marking forms the mark 9 on the outer surface 3*a* of the wire 3. As shown in FIGS. 1 and 2, the device 1 includes the first spouting unit 311 as the spouting means, the second spouting unit 312 as the spouting means, encoder 33 as the detecting means, and control device 34. The first and second spouting units 311 and 312 are arranged along arrow K.

As shown in FIG. 1, the spouting units 311, 312 are provided at the delivery roll 12-side of the slack-absorbing unit 14 of the wire cutting machine 2 and provided between the slack-absorbing unit 14 and the delivery roll 12. That is, the spouting units 311, 312 are provided at the downstream side of the slack-absorbing unit 14 along the transfer direction of the wire 3 and provided at the upstream side of the delivery roll 12 along the transfer direction of the wire 3. That is, the spouting units 311, 312 are provided between the delivery roll 12 and the corrective unit 13. The first spouting unit 311 includes a first nozzle 351 and a first valve 361.

The first nozzle 351 faces the wire 3, which is transferred along arrow K by the pair of the delivery rolls 12. The first nozzle 351 includes a hole 351*a*, through which the first coloring agent can pass. The hole 351*a* extends straightly toward the outer surface 3*a* of the wire 3. An opening 351*b* of the hole 351*a* faces the wire 3, which is transferred along arrow K by the delivery rolls 12.

The first spouting unit 311 includes the opening 351*b* which faces the wire 3. The opening 351*b* can guide the first coloring agent therethrough. The first coloring agent is supplied into the hole 351*a* of the first nozzle 351 from a first coloring agent-supply source 37 (shown in FIG. 2). The first coloring agent has the first color B. The first coloring agent-supply source 37 is connected to the first nozzle 351.

The first valve 361 is provided between the first nozzle 351 and the first coloring agent-supply source 37 and connected to them. Further, a pressurized gas-supply source 38 (shown in FIG. 2) is connected to the first coloring agent-supply source 37. The pressurized gas-supply source 38 supplies pressurized gas into the first coloring agent-supply source 37. Further, pressurized gas-supply source 38 supplies pressurized gas into a second coloring agent-supply source 41 (explained later on).

When the first valve 361 is opened, with the aid of the pressurized gas supplied from the pressurized gas-supply source 38, the first coloring agent within the hole 351*a* of the first nozzle 351 spouts toward the outer surface 3*a* of the wire 3 passing through the opening 351*b*. Thus, the first spouting unit 311 spouts the first coloring agent through the opening 351*b*, which faces the outer surface 3*a* of the wire 3. At this time, the first spouting unit 311 spouts the first coloring agent along arrow K1 shown in FIG. 4, which is parallel to the longitudinal direction of the hole 351*a*. The arrow K1 indicates the spouting direction described in the claims and this specification.

When the valve 361 is closed, the spouting of the first coloring agent within the first nozzle 351 is halted. In response to a signal from a valve-driving circuit 46 (explained later on) of the control device 34, the first valve 361 is opened for a predetermined period of time, thereby the first spouting unit 311 spouts a specific amount of the first coloring agent toward the outer surface 3*a* of the wire 3.

As shown in FIG. 1, the second spouting unit 312 is provided at the upstream side of the first spouting unit 311 along the transfer direction K of the wire 3.

The second spouting unit 312 includes a second nozzle 352 and a second valve 362. The second nozzle 352 faces the wire 3, which is transferred along arrow K by the pair of the delivery rolls 12. The second nozzle 352 includes a hole 352*a*, through which the second coloring agent can pass. The hole 352*a* extends straightly toward the outer surface 3*a* of the wire 3. An opening 352*b* of the hole 352*a* faces the wire 3, which is transferred along arrow K by the delivery rolls 12.

The second spouting unit 312 includes the opening 352*b* which faces the wire 3. The opening 352*b* can guide the second coloring agent therethrough. The second coloring agent is supplied into the hole 352*a* of the second nozzle 352 from a second coloring agent-supply source 41 (shown in FIG. 2). The second coloring agent has the second color R. The second coloring agent-supply source 41 is connected to the second nozzle 352.

The second valve 362 is provided between the second nozzle 352 and the second coloring agent-supply source 41 and connected to them. Further, the pressurized gas-supply source 38 is connected to the second coloring agent-supply source 41. When the second valve 362 is opened, with the aid of the pressurized gas supplied from the pressurized gas-supply source 38, the second coloring agent within the hole 352*a* of the second nozzle 352 spouts toward the outer surface 3*a* of the wire 3 passing through the opening 352*b*. Thus, the second spouting unit 312 spouts the second coloring agent through the opening 352*b*, which faces the outer surface 3*a* of the wire 3. At this time, the second spouting unit 312 spouts the second coloring agent along arrow K2 shown in FIG. 5, which is parallel to the longitudinal direction of the hole 352*a*. The arrow K2 indicates the spouting direction described in the claims and this specification.

When the valve 362 is closed, the spouting of the second coloring agent within the second nozzle 352 is halted. In response to a signal from the valve-driving circuit 46 of the control device 34, the second valve 362 is opened for a predetermined period of time, thereby the second spouting unit 312 spouts a specific amount of the second coloring agent toward the outer surface 3*a* of the wire 3. Thus, the first and second spouting units 311 and 312 spout the specific amount of the respective coloring agents as a drop.

The first and second coloring agents described above correspond to the coloring agents described in the claims and this specification, and mean liquid substances, in which the coloring material (organic substance for use in industry) is dissolved and dispersed in water or other solvent. The organic substance described above is a dye or a pigment (mainly, organic substance and synthetic product). Sometimes, a dye is used as a pigment and a pigment is used as a dye. As a substantial example, the coloring agent is a coloring liquid or coating material.

The coloring liquid is a liquid, in which a dye is dissolved or dispersed in a solvent. The coating material is a material, in which a pigment is dispersed in a liquid dispersion. When the coloring agent adheres on the outer surface 3*a* of the wire 3, the dye permeates into the coating 5. When the coating material adheres on the outer surface 3*a* of the wire 3, the pigment adheres on the outer surface 3*a* of the wire 3 without permeating into the coating 5.

That is, the first and second spouting units 311 and 312 dyes a part of the outer surface 3*a* of the wire 3 with a dye, or alternatively, give a part of the outer surface 3*a* of the wire 3 of a coat of a pigment. That is, marking the outer surface 3*a* of the wire 3 means dyeing a part of the outer surface 3*a* of the wire 3 with a dye, or alternatively, giving a part of the outer surface 3*a* of the wire 3 of a coat of a pigment.

Preferably, the solvent and liquid dispersion have an affinity to the synthetic resin for constituting the coating 5 in order to securely permeate the dye into the coating 5 or to make the pigment securely adhere to the outer surface 3*a*.

Further, spouting the coloring agent as a drop means that the liquid coloring agent in its state of a drop is ejected toward the outer surface 3*a* of the wire 3 with the aid of bias. That is, the nozzles 351, 352 of the device 1 for automatically marking according to the preferred embodiment ejects the coloring agent in its state of a drop toward the outer surface 3*a* of the wire 3 with the aid of bias.

As shown in FIG. 2, the encoder 33 includes a pair of rotors 42. The rotors 42 are provided at the downstream side of the delivery roll 12 along the transfer direction K of the wire 3. The rotor 42 is rotatable around the axis. The outer circumferential surface of the rotor 42 comes in contact with the outer surface 3*a* of the wire 3, which is put between the delivery rolls 12. The pair of the rotors 42 puts the wire 3 therebetween. When the core wire 4 moves, that is, the wire 3 moves along arrow K, the rotor 42 rotates. Of course, the transfer distance of the core wire 4, that is, the transfer distance of the wire 3 along arrow K has a linear relation with the revolving number of the rotor 42.

The encoder 33 is connected to a pulse count circuit 44 (explained later on) of the control device 34. When the rotor 42 rotates by an every specific angle, the encoder 33 outputs a pulse signal to the control device 34. That is, the encoder 33 outputs an information in response to the transfer speed of the wire 3 transferring along arrow K to the pulse count circuit 44. Thus, encoder 33 measures an information in response to the transfer speed of the wire 3 and outputs the information in response to the transfer speed of the wire 3 to the pulse count circuit 44. Usually, the encoder 33 outputs a pulse signal in response to the transfer distance of the wire 3 with friction between the wire 3 and the rotor 42. However, in, the event that the transfer distance does not agree with the number of the pulse depending on the state of the outer surface 3*a* of the wire 3, the information of the speed may be obtained at another position and the information obtained may be fed back so as to carry out a specific comparative computation.

Figure 3:
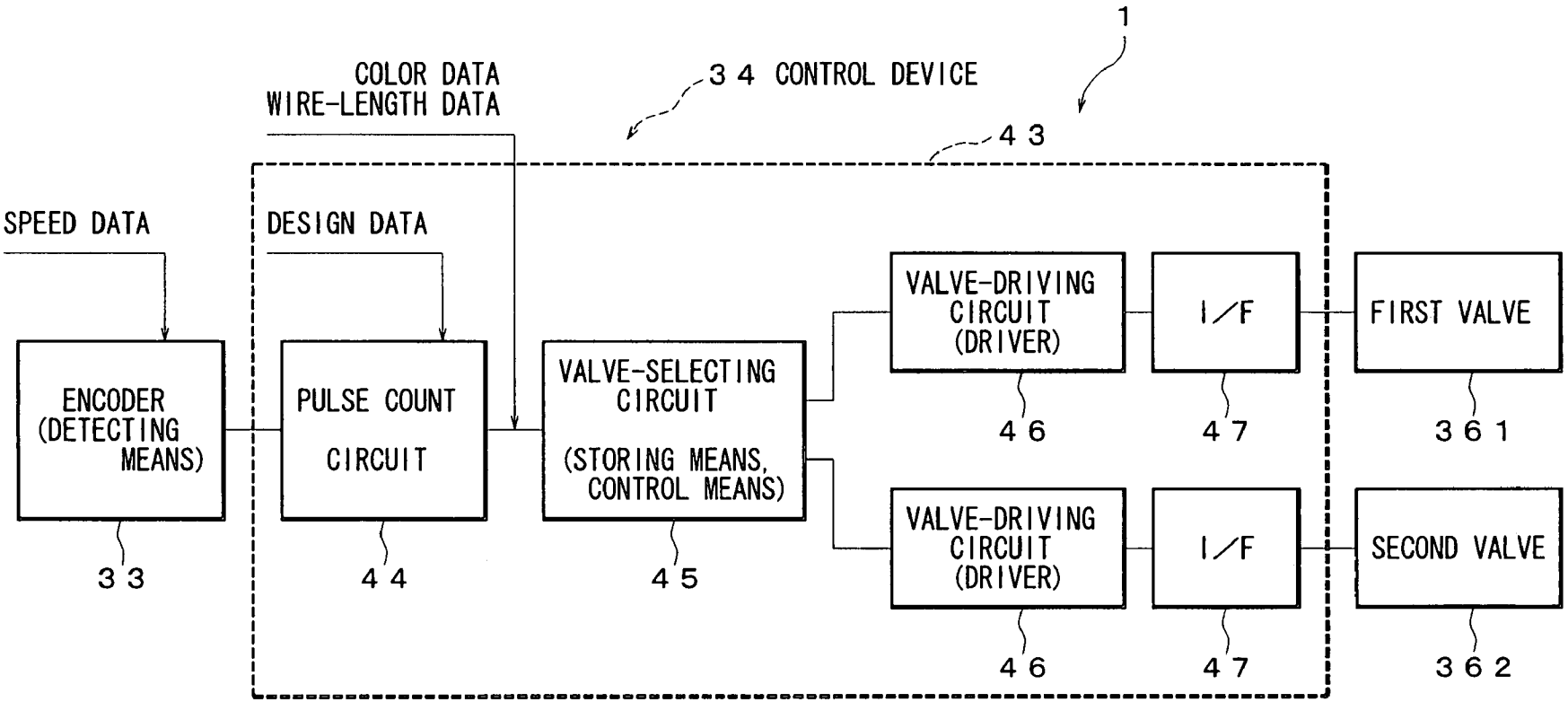
FIG. 3 illustrates mainly a construction of a control device of the device for automatically marking an article shown in FIG. 2.

As shown in FIG. 3, the control device 34 includes a box-shaped device body 43, the pulse count circuit 44, valve-selecting circuit 45, a plurality of valve-driving circuits 46, and a plurality of interfaces (shown by I/F in FIG. 3; hereinafter I/F) 47 as connectors. The device body 43 receives the pulse count circuit 44, valve-selecting circuit 45, and a plurality of the valve-driving circuits 46.

The pulse count circuit 44 counts the number of the pulse signals inputted from the encoder 33. The pulse count circuit 44 is connected to the valve-selecting circuit 45 and outputs an information indicating which number of the pulse signal is inputted at that time to the valve-selecting circuit 45. In order to improve the resolution of the pulse, the pulse signal generated in the encoder of very high frequency may be divided so as to input it to the pulse count circuit 44.

The valve-selecting circuit 45 is connected to the valve-driving circuits 46. When a pulse signal of the predetermined turn is inputted, the valve-selecting circuit 45 outputs a signal for opening the respective valves 361, 362 to the valve-driving circuits 46. The valve-selecting circuit 45 outputs a signal for opening the respective valves 361, 362 to the valve-driving circuits 46 according to a pattern of the mark 9 to be formed on the outer surface 3*a* of the wire 3 such as the distances D1, D2 and D3 and a distance L (shown in FIG. 2) between the centers C1 and C2 of the respective openings 351*b* and 352*b*. Here, the distance L is a distance between the spouting means.

That is, the valve-selecting circuit 45 memorizes which is to be opened the first valve 361 or second valve 362, or alternatively, both of which to be kept closed, and controls respective valve-driving circuits 46 according to this memorized pattern. When the pulse count circuit 44 is directly connected to the valve-driving circuit 46, the valve-selecting circuit 45 can be passed.

Thus, the valve-selecting circuit 45 memorizes in advance a pattern for marking the outer surface 3*a* of the wire 3. The valve-driving circuit 46 makes the respective spouting units 311, 312 spout the specific amount of the first or second coloring agent toward the outer surface 3*a* of the wire 3 in accordance with the memorized pattern in response to the transfer speed of the wire 3 inputted from the encoder 33. The valve-selecting circuit 45 makes the respective spouting units 311, 312 spout the first or second coloring agent according to the distance L between the centers C1 and C2 of the openings 351*b* and 352*b*, respectively. The valve-selecting circuit 45 corresponds to both the storing means and control means. The pulse count circuit 44 or the valve-selecting circuit 45 consists of a known digital circuit or the like.

The valve-driving circuit 46 and I/F 47 are provided in the same number as the spouting units 311 or 312, corresponding to the respective spouting units 311 and 312. Valves 361 and 362 of the respective spouting units 311 and 312 are connected to the valve-driving circuit 46 through the I/F 47. When a signal for opening the valve 361, 362 is inputted from the valve-selecting circuit 45, the valve-driving circuit 46 outputs the signal to the valve 361, 362 through I/F 47 and so on. When the valve-driving circuit 46 outputs the signal for opening the valve 361, 362 to the valve 361, 362, then the valve 361, 362 is opened.

Thus, the valve-driving circuit 46 outputs the signal described above to the corresponding valves 361, 362 so as to control the opening/closing motion of the corresponding valves 361, 362. The I/F 47 is used for electrically connecting the valve-driving circuit 46 to the corresponding valves 361, 362. The I/F 47 is attached to, for example, an outer wall of the device body 43.

In the device 1, when the mark 9 is formed on the outer surface 3*a* of the wire 3, that is, when the outer surface 3*a* of the wire 3 is marked, first the guide roll 11 is mounted on the frame 10. The pair of the cutting blades 30*a* and 30*b* is kept apart from each other and the wire 3 wound around the guide roll 11 is passed in turn through the corrective unit 13, slack-absorbing unit 14, spouting units 311, 312 and duct 16, and put between the pair of the delivery rolls 12. Then, the nozzles 351, 352 of the spouting units 311, 312 are mounted on specific positions and the coloring agent-supply sources 37, 41 are connected to the respective nozzles 351, 352. Further, the pressurized gas-supply source 38 is connected to the coloring agent-supply sources 37, 41 and gas within the duct 16 is sucked by suck means.

Then, the delivery rolls 12 is rotated, the wire 3 is pulled from the guide roll 11 so as to transfer the wire 3 along the longitudinal direction of the wire 3, and the corrective unit 13 gives the friction force of the first bias force H1 to the wire 3 so as to stretch the wire 3. Then, the air cylinder 27 gives the second bias force H2 to the transfer roll 26, that is, to the wire 3.

Figure 4:
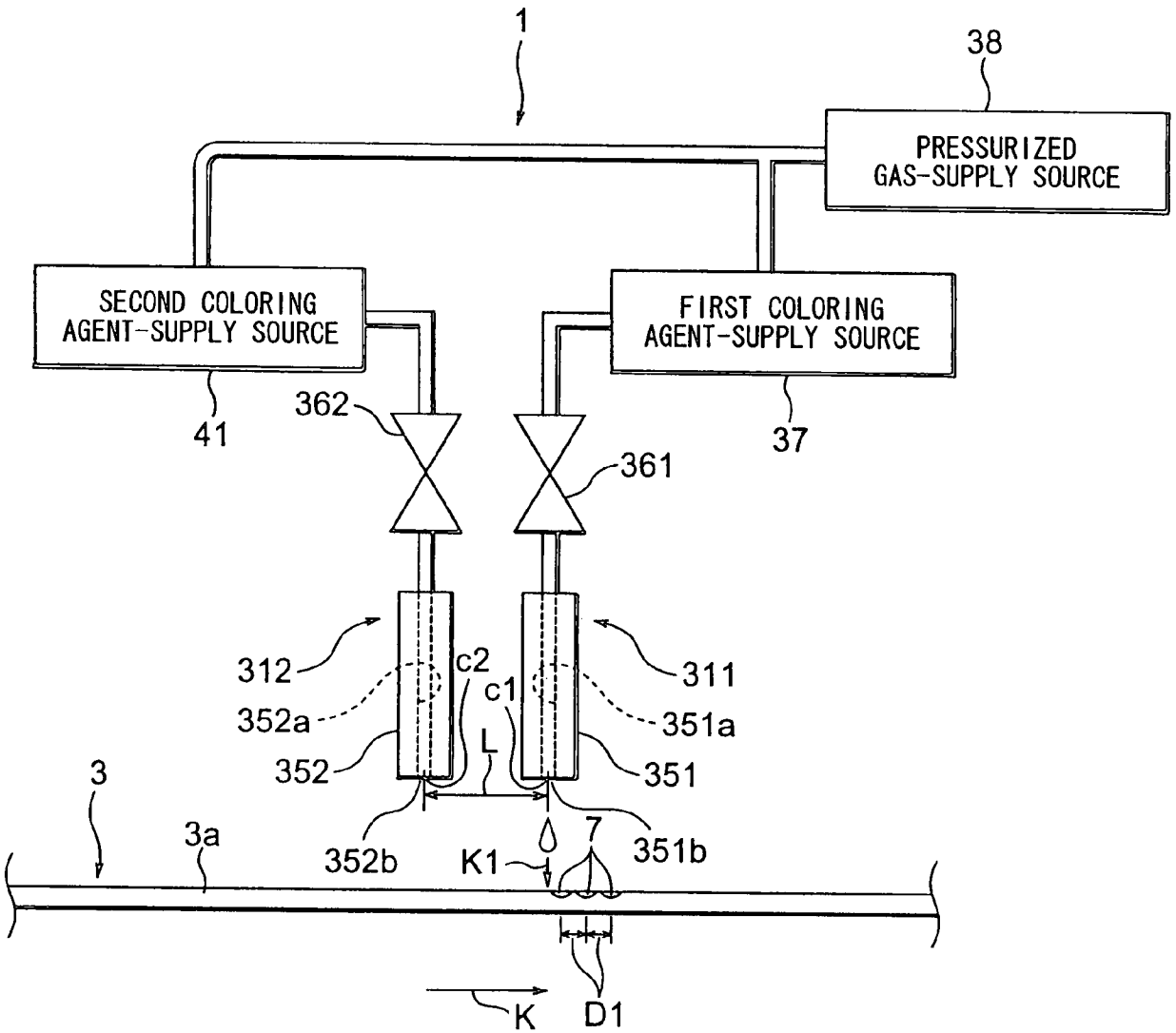
FIG. 4 illustrates a state when the first spouting unit of the device for automatically marking an article shown in FIG. 2 is in operation.

When the pulse signal of a specific turn is inputted to the pulse count circuit 44 from the encoder 33, first the valve-driving circuit 46 that is connected to the first valve 361 opens the first valve 361 six times for a specific period of time according to the distance D1 described above. Then, as shown in FIG. 4, the first spouting unit 311 spouts (ejects) the specific amount of the first coloring agent toward the outer surface 3*a* of the wire 3.

Then, the solvent or liquid dispersion evaporates from the coloring agent adhered on the outer surface 3*a* of the wire 3 so as to dyes the outer surface 3*a* of the wire 3 with the dye, or alternatively, coats the pigment on the outer surface 3*a*. The solvent or liquid dispersion evaporated from the coloring agent adhered on the outer surface 3*a* of the wire 3 is sucked by the suck means from the duct 16. Thus, the outer surface 3*a* of the wire 3 is colored.

Figure 5:
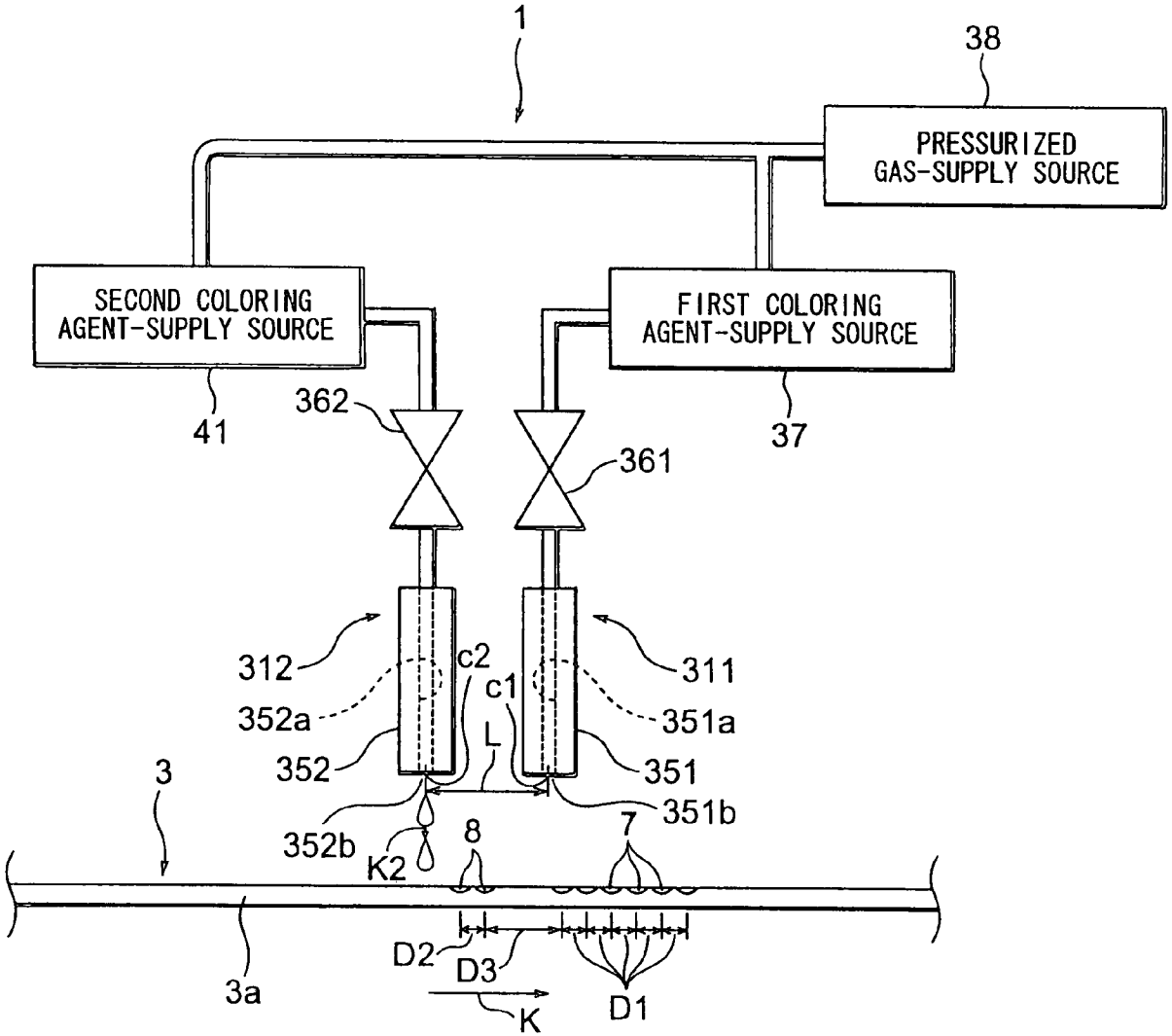
FIG. 5 illustrates a state when the second spouting unit of the device for automatically marking an article shown in FIG. 2 is in operation.

After the spouting by the first spouting unit 311 is once halted, when the pulse signal, which indicates that the wire 3 is transferred according the distance D3 and L described above, is inputted to the pulse count circuit 44 from the encoder 33, the valve-driving circuit 46 that is connected to the second valve 362 opens the second valve 362 four times for a specific period of time according to the distance D2 described above. Then, as shown in FIG. 5, the second spouting unit 312 spouts (ejects) the specific amount of the second coloring agent toward the outer surface 3*a* of the wire 3.

After the spouting by the second spouting unit 312 is once halted, when the pulse signal, which indicates that the wire 3 is transferred according the distance D3 and L described above, is inputted to the pulse count circuit 44 from the encoder 33, the valve-driving circuit 46 that is connected to the first valve 361 opens again the first valve 361 six times for a specific period of time according to the distance D1 described above. Then, the first spouting unit 311 spouts (ejects) the specific amount of the first coloring agent toward the outer surface 3*a* of the wire 3.

When the control device 34 judges that the wire 3 of the specific length is delivered on the basis of the information from the encoder and so on, the control device 34 halts the motion of the delivery roll 12. Then, the wire 3 slackens between the pair of the guide rollers 24 of the slack-absorbing unit 14 and the transfer roller 26 biased by the second bias force H2 shifts to a position indicated by an alternate long and two short dashes line shown in FIG. 1. Then, the stretch rod 29 of the air cylinder 27 of the slack-absorbing unit 14 extends. Then, the slack-absorbing unit 14 absorbs the slack of the wire 3.

Then, the pair of the cutting blades 30*a* and 30*b* approaches each other and puts the wire 3 therebetween. Thus, the wire 3 shown in FIG. 6, on the outer surface of which the mark 9 is formed, is produced.

According to the preferred embodiment, the respective specific amount of the first and second coloring agents are spouted (ejected) toward the outer surface 3*a* of the wire 3, thereby marking the outer surface 3*a*. Since the respective specific amount of the first and second coloring agents are spouted (ejected), upon changing the coloring agent to be adhered on the outer surface 3*a* of the wire 3, these coloring agents are prevented from being mixed with each other and the coloring agent can be changed immediately. Accordingly, the production yield of the wire 3 can be prevented from deteriorating and the color of the mark 9 to be formed on the wire 3 can be changed easily.

The encoder 33 detects the transfer speed of the wire 3 and the control device 34 controls the spouting of a plurality of the coloring agents toward the outer surface 3*a* of the wire 3 according to the transfer speed. The pulse count circuit 44 counts the pulse signals sent from the encoder 33 and the valve-selecting circuit 45 opens or closes the respective valves 361, 362 according to the turn of the pulse signals. When the transfer speed of the wire 3 increases, the time interval of spouting of the coloring agent becomes short, while when the transfer speed of the wire 3 decreases, the time interval of spouting of the coloring agent becomes long.

Therefore, even if the transfer speed of the wire 3 changes, the distances between the coloring agents adhered on the outer surface 3*a* of the wire 3, that is, the distances D1, D2 and D3 can be maintained constant. That is, even if the transfer speed of the wire 3 changes, the coloring agents can be adhered on the outer surface 3*a* of the wire 3 according to a predetermined pattern. That is, the outer surface 3*a* of the wire 3 can be marked according to a predetermined pattern.

The first and second spouting units 311 and 312 are arranged along arrow K. Therefore, the outer surface 3*a* of the wire 3 can be securely marked with the first and second coloring agents. The valve-selecting circuit 45 memorizes the distance L described above and the valves 361, 362 are controlled according to the distance L. Therefore, the outer surface 3*a* of the wire 3 can be marked according to a predetermined pattern.

The I/F 47 for connecting to the spouting units 311 or 312 are provided in the same number as the spouting units 311 or 312 in the device body 43 of the control device 34. Therefore, only one device body 43, that is, only one control device 34 can securely control the first and second spouting units 311 and 312, thereby reducing a necessary space for installing.

The device 1 for automatically marking is mounted on the wire cutting machine 2. Therefore, when the wire having long length is to be cut into a specific length, the wire 3 can be marked with a specific pattern. Therefore, the man-hour required to process the wire 3 can be restricted.

In the following, a device 1 for automatically marking an electric wire (hereinafter, a device for automatically marking) as a device for automatically marking an article according to a second preferred embodiment of the present invention will be explained with reference to FIGS. 8-10.

Figure 9:
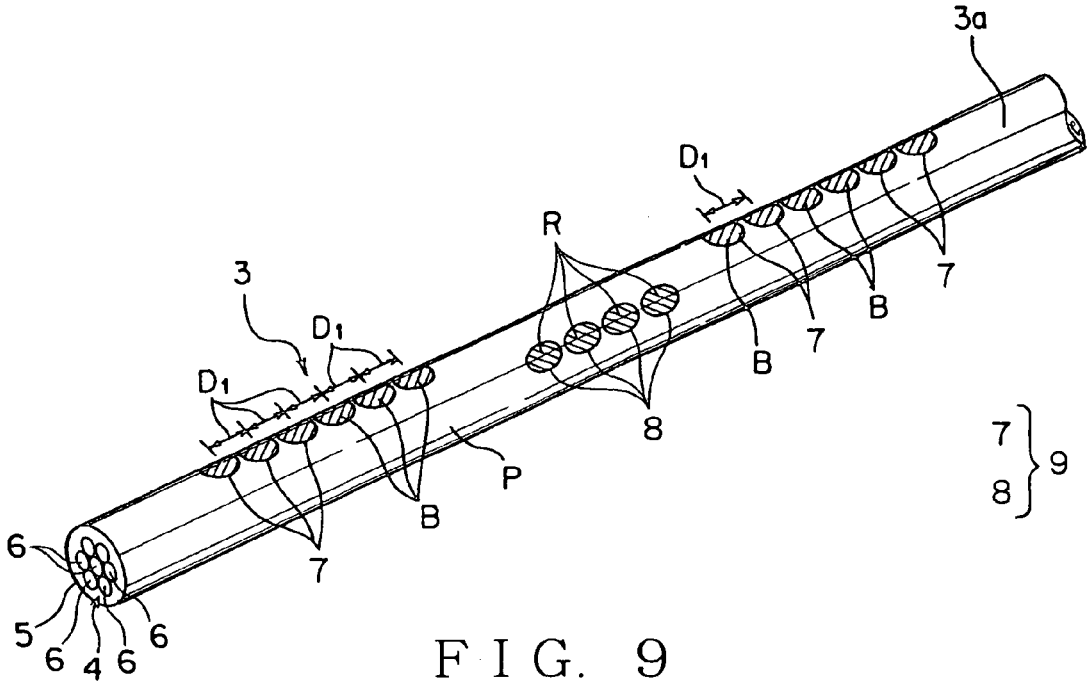
FIG. 9 is a perspective view of an electric wire which is marked by the device for automatically marking an article shown in FIG. 8.
Figure 10:
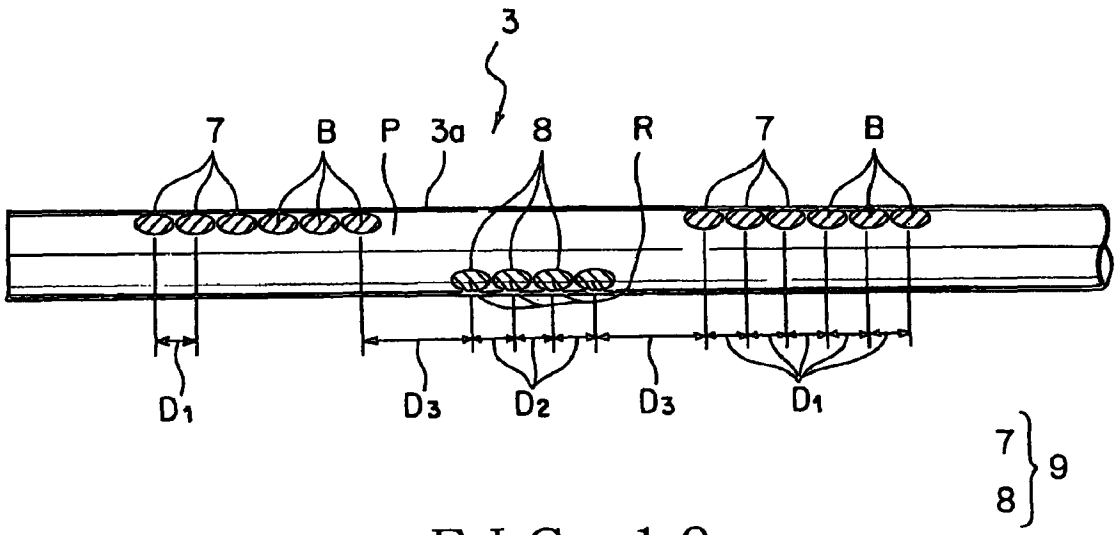
FIG. 10 is a plan view of the electric wire shown in FIG. 9.
Figure 14:
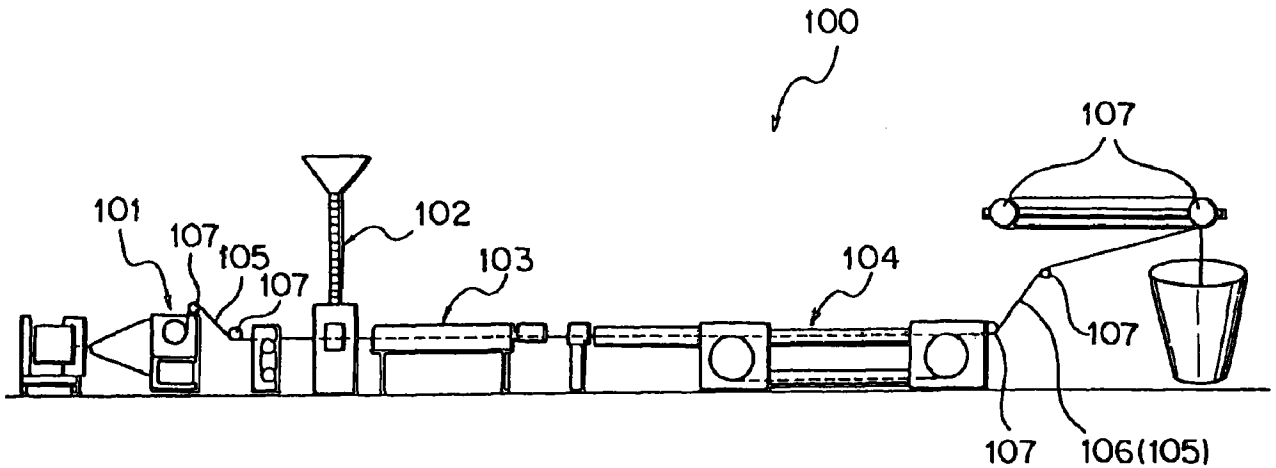
FIG. 14 illustrates a construction of a conventional device for producing a colored electric wire.

As shown in FIGS. 9 and 10, the device 1 for automatically marking according to the second preferred embodiment forms a mark 9 on the outer surface 3*a* of the wire 3. That is, the device 1 marks the outer surface 3*a* of the wire 3. As shown in FIGS. 9 and 10, in the wire 3 marked by the device 1 for automatically marking according to the second preferred embodiment, the first spot 7 shifts relatively from the second spot 8 in the circumferential direction of the wire 3.

Figure 8:
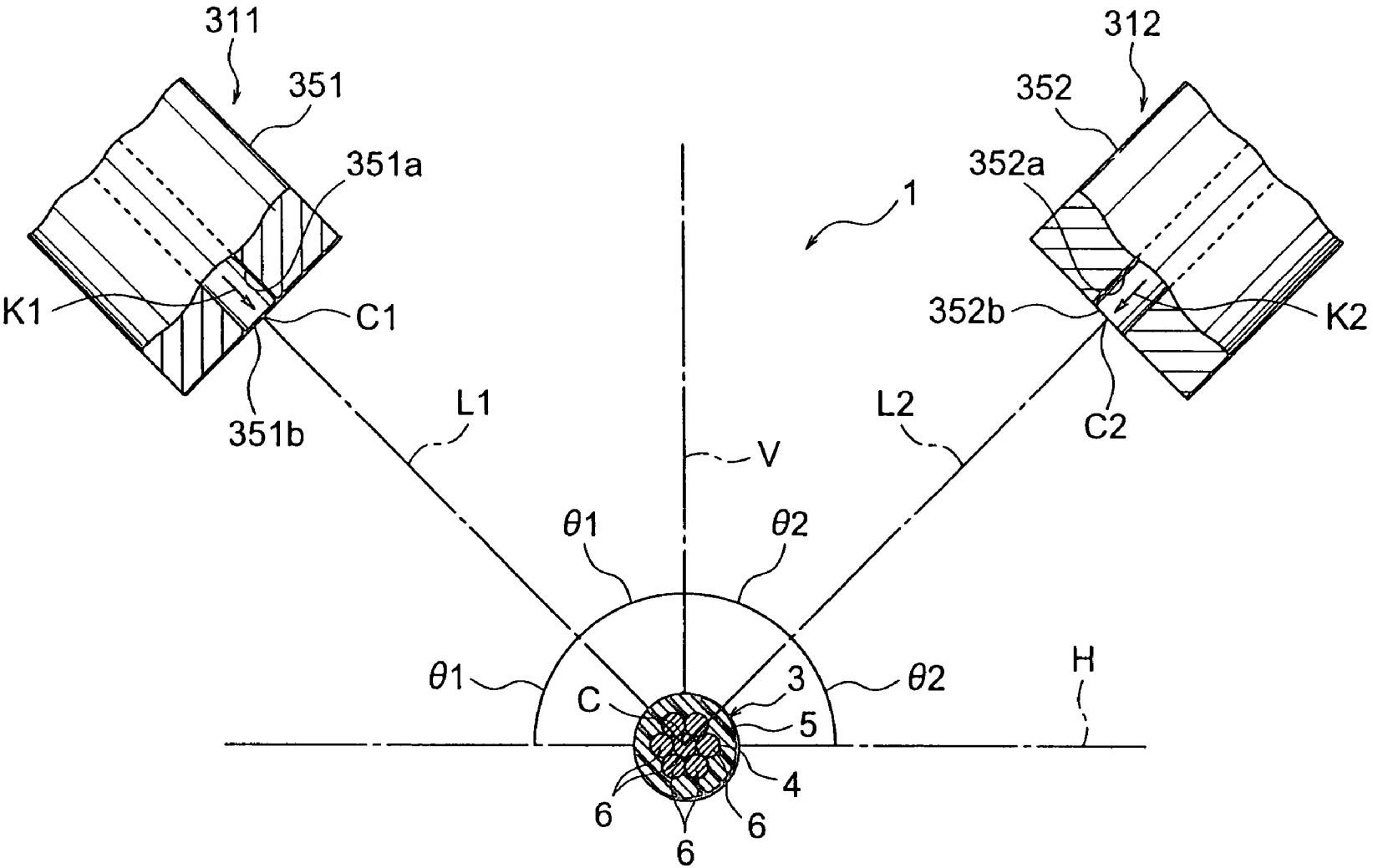
FIG. 8 is a cross sectional view illustrating a construction of a primary part of a device for automatically marking an article according to the second preferred embodiment of the present invention.

As shown in FIG. 8, in the device 1 for automatically marking according to the second preferred embodiment, the first and second spouting units 311 and 312 are arranged in the circumferential direction of the wire 3 that is transferred along arrow K. A straight line L1 (shown by an alternate long and two short dashes line in FIG. 8) obtained by connecting the center C1 of an opening 351*b* of a hole 351*a* of the first nozzle 351 of the first spouting unit 311 with the center C of the wire 3 is parallel to arrow K1. Further, the straight line L1 crosses both the vertical direction V shown by an alternate long and two short dashes line in FIG. 8 and the horizontal direction H shown by an alternate long and two short dashes line in FIG. 8 at an angle of θ1=45°.

A straight line L2 (shown by an alternate long and two short dashes line in FIG. 8) obtained by connecting the center C2 of an opening 352*b* of a hole 352*a* of the second nozzle 352 of the second spouting unit 312 with the center C of the wire 3 is parallel to arrow K2. Further, the straight line L2 crosses both the vertical direction V and the horizontal direction H at an angle of θ2=45°.

Similarly to the first preferred embodiment, in the device 1 for automatically marking according to the second preferred embodiment, when the delivery rolls 12 of a wire cutting machine 2 transfer the wire 3 along arrow K, a control device 34 opens or closes the respective valves 361 and 362 on the basis of a signal sent from an encoder 33. Then, the device 1 marks the outer surface 3*a* of the wire 3 according to a predetermined pattern.

After the delivery rolls 12 of the wire cutting machine 2 deliver the wire 3 for a specific length, the delivery rolls 12 are halted. Cutting blades 30*a*, 30*b* of a cutting mechanism 18 cuts the wire 3, on the surface 3*a* of which the mark 9 is formed. Thus, the wire 3 shown in FIGS. 9 and 10, on the surface 3*a* of which the mark 9 is formed, is produced.

According to the second preferred embodiment, similarly to the first preferred embodiment, since the respective specific amount of the first and second coloring agents are spouted, upon changing the coloring agent to be adhered on the outer surface 3*a* of the wire 3, these coloring agents are prevented from being mixed with each other and the coloring agent can be changed immediately. Accordingly, the production yield of the wire 3 can be prevented from deteriorating and the color of the mark 9 to be formed on the wire 3 can be changed easily.

The encoder 33 detects the transfer speed of the wire 3 and the control device 34 controls the spouting of a plurality of the coloring agents toward the outer surface 3*a* of the wire 3 according to the transfer speed. Therefore, even if the transfer speed of the wire 3 changes, the distances between the coloring agents adhered on the outer surface 3*a* of the wire 3, that is, the distances D1, D2 and D3 can be maintained constant. That is, even if the transfer speed of the wire 3 changes, the coloring agents can be adhered on the outer surface 3*a* of the wire 3 according to a predetermined pattern. That is, the outer surface 3*a* of the wire 3 can be marked according to a predetermined pattern.

The I/F 47 for connecting to the spouting units 311 or 312 are provided in the same number as the spouting units 311 or 312 in the device body 43 of the control device 34. Therefore, only one device body 43, that is, only one control device 34 can securely control the first and second spouting units 311 and 312, thereby reducing a necessary space for installing.

The device 1 for automatically marking is mounted on the wire cutting machine 2. Therefore, when the wire having long length is to be cut into a specific length, the wire 3 can be marked with a specific pattern. Therefore, the man-hour required to process the wire 3 can be restricted.

Since a plurality of the spouting units 311, 312 are arranged in the circumferential direction of the wire 3 in the second preferred embodiment, the device 1 for automatically marking can be made compact.

Further, since a plurality of the spouting units 311, 312 are arranged in the circumferential direction of the wire 3, a distance between the delivery rolls 12 and the spouting units 311, 312 along arrow K, that is, in the longitudinal direction of the wire 3 can be reduced. Therefore, the wire 3 can be prevented from shaking in the vicinity of the spouting units 311, 312 and the spouting units 311, 312 can securely mark the outer surface 3*a* of the wire 3.

Further, each straight line L1, L2 crosses both the vertical direction V and the horizontal direction H at an angle of θ1, θ2=45°. Therefore, even if the wire 3 shakes along both the vertical direction V and the horizontal direction H, the spouting units 311, 312 can securely mark the outer surface 3*a* of the wire 3.

Figure 11:
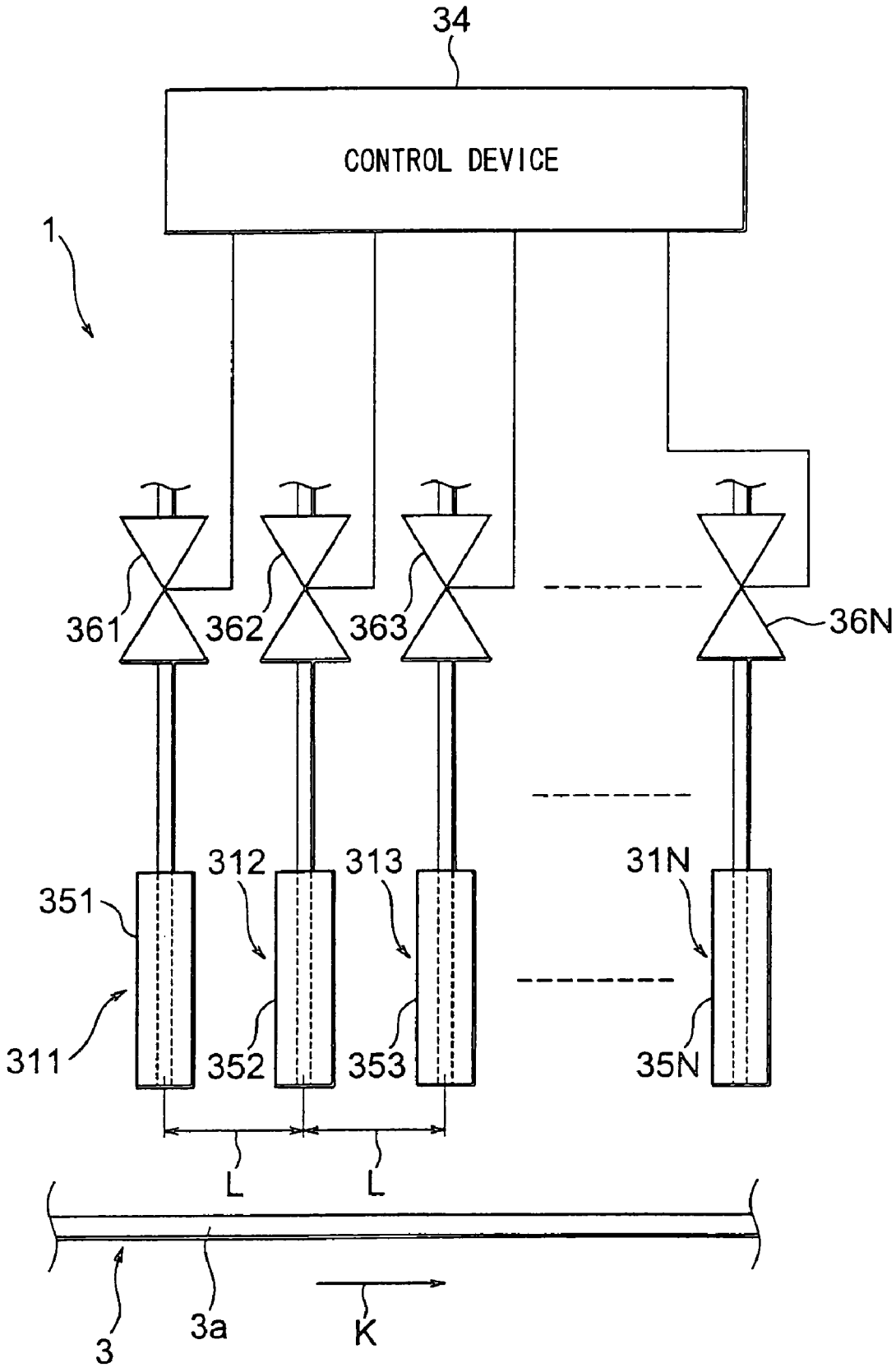
FIG. 11 illustrates a construction of a primary part of a modified example of the device for automatically marking an article shown in FIG. 2.
Figure 12:
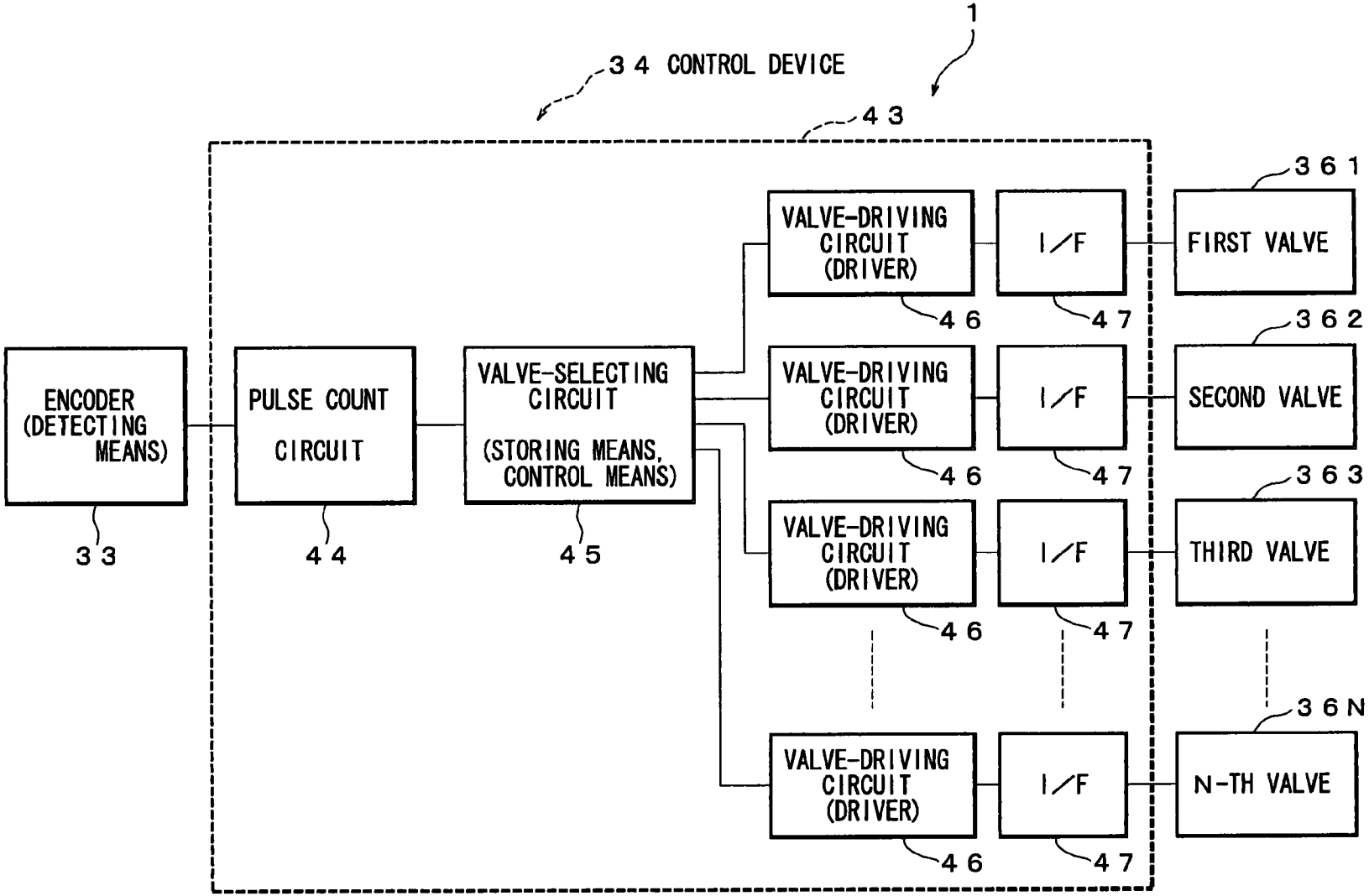
FIG. 12 illustrates mainly a construction of a control device of the device for automatically marking an article shown in FIG. 11.

In the preferred embodiments described above, the device 1 for automatically marking includes two spouting units 311 and 312. However, instead, in the present invention, as shown in FIGS. 11 and 12, the device 1 may include three or more spouting units 311, 312, 313, - - - , 31N as the spouting means. For an example shown in FIGS. 11 and 12, the device 1 includes N spouting units 311, 312, 313, - - - , 31N (N:integer) and the device body 43 of the control device 34 includes N I/F 47. These spouting units 311, 312, 313, - - - , 31N have the respective nozzles 351, 352, 353, - - - , 35N and the respective valves 361, 362, 363, - - - , 36N.

Figure 13:
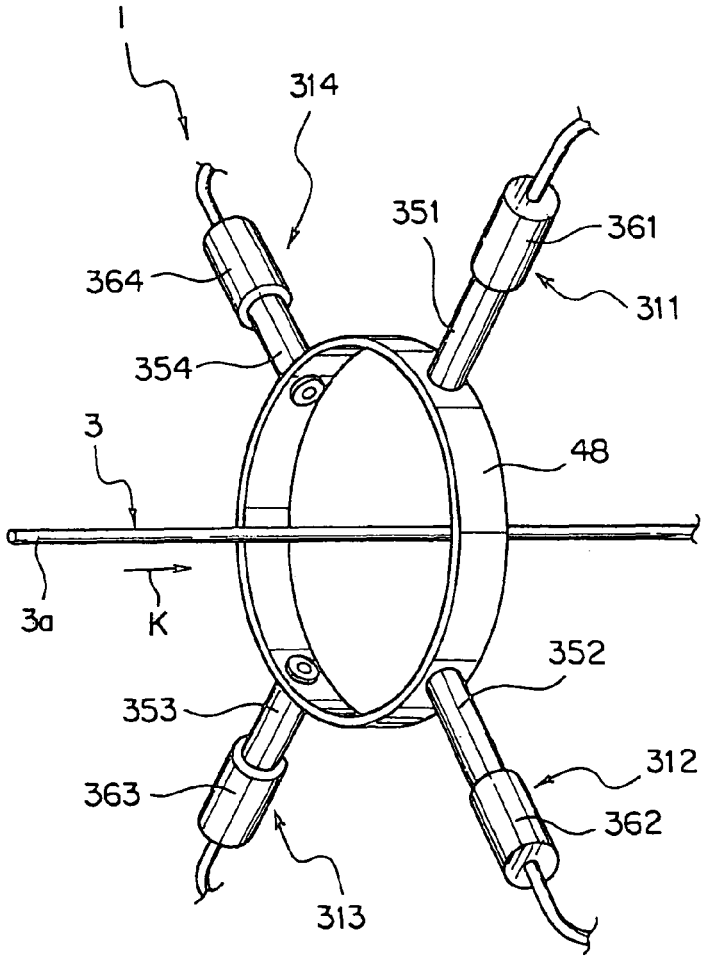
FIG. 13 is a perspective view illustrating a primary part of another modified example of the device for automatically marking an article shown in FIG. 2.

As shown in FIG. 13, in the present invention, the spouting units 311, 312, 313, and 314 as the spouting means may be arranged in the circumferential direction around the wire 3. For an example shown in FIG. 13, the respective spouting units 311, 312, 313, and 314 are attached to a ring-shaped member 48 around the wire 3. The respective spouting units 311, 312, 313, and 314 are arranged in the circumferential direction around the wire 3 having the same distance therebetween. Further, respective straight lines obtained by connecting the centers of the openings of the holes of the respective nozzles 351, 352, 353 and 354 of the respective spouting units 311, 312, 313, and 314 and the center of the wire 3 is parallel to the respective spouting direction of the respective coloring agents. Furthermore, each straight line crosses both the vertical direction and the horizontal direction at an angle of 45°.

Of course, in this case, the device 1 includes respective valves 361, 362, 363 and 364 for the respective nozzles 351, 352, 353 and 354.

For an example shown in FIG. 13, the device 1 includes four spouting units 311, 312, 313 and 314. However, instead, in the present invention, the device 1 may include two or more spouting units.

For an example shown in FIG. 13, since plurality of the spouting units 311, 312, 313, and 314 are arranged in the circumferential direction around the wire 3, the outer surface 3*a* of the wire 3 can be securely marked with a plurality of the coloring agents. For the example shown in FIG. 13, the device 1 for automatically marking can be made compact and the outer surface 3*a* of the wire 3 can be securely marked.

In the preferred embodiment described above, the control device 34 is constructed by digital circuits and so on. However, instead, in the present invention, the control device 34 may be constructed by a computer including a known RAM, ROM, CPU and known nonvolatile storage such as EPROM. In this case, the nonvolatile storage such as the EPROM is the storing means and the CPU is the control means.

In the preferred embodiment described above, the outer surface 3*a* of the wire 3 as the article is marked as an example. However, instead, the device 1 for automatically marking may mark not only the electric wire 3 but also an outer surface of various articles being transferred by, for example, a known belt conveyer and the like. The article may be, for example, a connector housing, grommet, protector and various circuit components. In the present invention, the article means a matter, onto which the marking can be applied. When a connector housing, grommet, protector or various circuit components is transferred by a belt conveyer, the encoder 33 detects the transfer speed of an endless ring-shaped belt of the belt conveyer.

Further, in the preferred embodiment described above, explained is the electric wire 3 for constituting a wiring harness to be mounted on a motor vehicle. However, instead, in the present invention, the wire 3 may be used not only for a motor vehicle but also for various electronic equipment such as a portable computer and various electric machines.

Further, in the present invention, various matters such as acrylic-based coating material, ink (dye-based or pigment-based) and ultraviolet ink (UV ink) may be used as the coloring liquid or the coating material.

INDUSTRIAL APPLICABILITY

According to the present invention, a plurality of the coloring agents of the respective specific amount are spouted toward the outer surface of the article so as to mark the outer surface. Since the coloring agents of the respective specific amount are spouted, therefore when one coloring agent is replaced by the other coloring agent, the coloring agent is prevented from being mixed with the other coloring agent and the coloring agent to be adhered on the article can be changed immediately. Accordingly, the yield of the article can be prevented from deteriorating and the color for the mark to be formed on the article can be easily changed.

Further, the transfer speed of the article is detected and a plurality of the coloring agents are spouted toward the outer surface of the article in response to the detected transfer speed. Therefore, even when the transfer speed of the article changes, the distance between the coloring agents adhered on the outer surface of the article can be maintained constant. That is, the outer surface of the article can be marked according to a predetermined pattern.

According to the present invention, the outer surface of an electric wire as the article is marked. Since the marking is carried out in response to the transfer speed of the wire, the outer surface of the wire can be marked according to a predetermined pattern even when the transfer speed of the wire changes. Of course, the wire being transferred with a high speed can be securely marked and the wire having long length can be marked. Accordingly, the production yield of the electric wire can be prevented from deteriorating and the color for the mark to be formed on the wire can be easily changed.

According to the present invention, a plurality of the spouting means spout the respective specific amount of the coloring agents toward the outer surface of the article so as to mark the outer surface. A plurality of the spouting means spout the coloring agent of the respective different colors. Since the respective specific amount of the coloring agents are spouted, when one coloring agent to be adhered on the article is replaced by the other coloring agent, one coloring agent is prevented from being mixed with the other coloring agent and the coloring agent to be adhered on the article can be changed immediately. Accordingly, the yield of the article can be prevented from deteriorating and the color for the mark to be formed on the article can be easily changed.

Further, the detecting means detects the transfer speed of the article and the control means controls the spouting of a plurality of the coloring agents toward the outer surface of the article in response to the detected transfer speed. Therefore, even when the transfer speed of the article changes, the distance between the coloring agents adhered on the outer surface of the article can be maintained constant. Therefore, the outer surface of the article can be marked according to a predetermined pattern.

According to the present invention, a plurality of the spouting means are arranged along the transfer direction of the article. Therefore, the outer surface of the article can be securely marked with a plurality of the coloring agents. Further, the storing means stores a distance between the spouting means and the control means controls the spouting means to spout the coloring agent according to the distance between the spouting means. Therefore, the outer surface of the article can be marked according to a predetermined pattern.

According to the present invention, a plurality of the spouting means are arranged along a circumferential direction around the article. Therefore, the outer surface of the article can be securely marked with a plurality of the coloring agents. Since a plurality of the spouting means are arranged along a circumferential direction around the article, the device for automatically marking an article can be made compact.

Further, since a plurality of the spouting means are arranged along a circumferential direction around the article, a distance between means for transferring the article and the spouting means along the transferring direction of the article, that is, for example, the length direction of the electric wire can be shortened. Therefore, the article can be prevented from shaking in the vicinity of the spouting means, thereby the spouting means can securely mark the outer surface of the article.

According to the present invention, the spouting means spouts the coloring agent through an opening, which faces the outer surface of the article, a straight line obtained by connecting a center of the opening and a center of the article runs along a spouting direction of the coloring agent, and the spouting direction crosses both perpendicular and horizontal directions at an angle of 45°. Therefore, even when the article shakes both in the perpendicular and horizontal directions, the spouting means can securely mark the outer surface of the article.

According to the present invention, the device comprises a device body for receiving the storing means and the control means, wherein the device body comprises a plurality of connectors for connecting the device body to the spouting means and the connectors are provided in the same number as that of the spouting means according to the respective spouting means. Therefore, with one device body, a plurality of the spouting means can be securely controlled and a space for installing the device can be reduced.

According to the present invention, the outer surface of an electric wire as the article is marked. Since the marking is carried out in response to the transfer speed of the wire, the coloring agents can be adhered on the outer surface of the wire according to a predetermined pattern even when the transfer speed of the wire changes. Of course, the wire being transferred with a high speed can be securely marked and the wire of long length can be marked.

According to the present invention, the electric wire is put in an electric wire cutting machine which cuts the electric wire after transferring the electric wire in said one direction. Therefore, when a long electric wire is cut into a specific length, the wire can be marked with a specific pattern. A space for installing can be reduced and a man-hour for processing the wire can be reduced.

The invention claimed is:

1. A method of automatically marking an article which is transferred in one direction, comprising the steps of:

storing in advance a pattern for coloring an outer surface of the article with a plurality of coloring agents of respective colors different from each other;

detecting a transfer speed of the article with a pair of rotors;

outputting a pulse signal from the rotors to a pulse count circuit;

counting a number of the pulse signals with the pulse count circuit;

supplying the coloring agents;

supplying pressurized gas into a coloring agent supply source;

spouting a plurality of the coloring agents of respective specific amount, as a single drop at a time, to form aligned spots on the outer surface of the article, from a plurality of separate and spaced nozzles, for each respective color, arranged in a longitudinal direction of the article being transferred, each nozzle having a separate coloring agent supply source connected therewith and a valve disposed between the nozzle and the coloring agent supply source and connected to the pulse count circuit, toward the outer surface of the article according to the pattern in response to a signal from the pulse count circuit; and forming round spots in a plan view on the outer surface of the article, wherein the coloring agents, as a single drop at a time, are spouted toward the outer surface of the article with the aid of bias of the supplied pressurized gas.

2. The method of automatically marking an article according to claim 1, wherein the article is an electric wire.

3. A device for automatically marking an article which is transferred in one direction, comprising:

storing means for storing a pattern for coloring an outer surface of the article with a plurality of coloring agents of respective colors different from each other;

a pair of rotors for detecting a transfer speed of the article;

a pulse count circuit for receiving a pulse signal from the rotors and counting a number of the pulse signals;

a plurality of separate and spaced nozzles, for each respective color, arranged in a longitudinal direction of the article being transferred, each nozzle having a separate coloring agent supply source connected therewith for supplying the coloring agent to the corresponding nozzle and a valve disposed between the nozzle and the coloring agent supply source and connected to the pulse count circuit, for spouting the coloring agents of respective colors different from each other of respective specific amount, as a single drop at a time, to form aligned spots on the outer surface of the article, toward the outer surface of the article; and control means to make a plurality of the nozzles spout the coloring agent, as a single drop at a time, toward the outer surface of the article according to the pattern in response to a signal from the pulse count circuit; and a pressurized gas supply source connected to the plurality of the coloring agent supply sources for supplying pressurized gas to the plurality of the coloring agent supply sources, wherein when the valve is opened, the coloring agents existing in the nozzles are spouted, as a single drop at a time, toward the outer surface of the article with the aid of bias of the pressurized gas supplied from the pressurized gas supply source in order to form round spots in a plan view on the outer surface of the article.

4. The device for automatically marking an article according to claim 3, wherein a plurality of the nozzles are arranged along the transfer direction of the article and the control means makes the nozzles spout the coloring agent according to a distance between the nozzles.

5. The device for automatically marking an article according to claim 3, wherein a plurality of the nozzles are also arranged along a circumferential direction around the article.

6. The device for automatically marking an article according to claim 5, wherein the nozzles spouts the coloring agent as a drop through an opening, which faces the outer surface of the article, a straight line obtained by connecting a center of the opening and a center of the article runs along a spouting direction of the coloring agent, and the spouting direction crosses both perpendicular and horizontal directions at an angle of 45°.

7. The device for automatically marking an article as claimed in any one of claims 3-6, further comprising a device body for receiving the storing means and the control means, wherein the device body comprises a plurality of connectors for connecting the device body to the nozzles and the connectors are provided in the same number as that of the nozzles according to the respective nozzles.

8. The device for automatically marking an article as claimed in any one of claims 3-6, wherein the article is an electric wire.

9. The device for automatically marking an article according to claim 8, wherein the electric wire is put in an electric wire cutting machine which cuts the electric wire after transferring the electric wire in said one direction.

* * * * *